US011834135B2

(12) United States Patent
Phillips

(10) Patent No.: US 11,834,135 B2
(45) Date of Patent: Dec. 5, 2023

(54) PERSONAL WATERCRAFT CARGO ARTICULATED MECHANISM

(71) Applicant: Johnny Robert Phillips, Auburndale, FL (US)

(72) Inventor: Johnny Robert Phillips, Auburndale, FL (US)

( * ) Notice: Subject to any disclaimer, the term of this patent is extended or adjusted under 35 U.S.C. 154(b) by 226 days.

(21) Appl. No.: 17/557,249

(22) Filed: Dec. 21, 2021

(65) Prior Publication Data

US 2022/0266957 A1 Aug. 25, 2022

Related U.S. Application Data

(60) Provisional application No. 63/200,240, filed on Feb. 24, 2021.

(51) Int. Cl.
*B63B 34/10* (2020.01)
*B63B 25/28* (2006.01)

(52) U.S. Cl.
CPC ..... *B63B 25/28* (2013.01); *B63B 34/10* (2020.02)

(58) Field of Classification Search
CPC ..... B63B 25/00; B63B 25/002; B63B 25/18; B63B 25/20; B63B 25/28; B63B 34/10
USPC ..... 224/406, 502, 509; 114/364
See application file for complete search history.

(56) References Cited

U.S. PATENT DOCUMENTS 4,729,535 A * 3/1988 Frazier ..... A47J 37/0786 224/406
5,439,151 A * 8/1995 Clayton ..... B60R 9/065 224/521
5,518,159 A * 5/1996 DeGuevara ..... B60R 9/10 224/512
5,544,799 A * 8/1996 Didlake ..... B60R 9/06 224/523
7,124,704 B1 * 10/2006 Strom ..... B63B 17/00 114/364
7,886,677 B2 * 2/2011 Strom ..... B63B 25/002 114/364
8,167,259 B2 * 5/2012 Spang, Jr. ..... A61M 39/283 248/230.4
8,434,654 B2 * 5/2013 Smith ..... B63B 25/00 280/491.1
8,720,760 B1 * 5/2014 Simpson ..... B62D 43/02 224/532
8,833,289 B2 * 9/2014 Isaac ..... B63B 17/00 114/364
10,577,057 B1 * 3/2020 Hull ..... B63B 32/70
(Continued)

*Primary Examiner* — Justin M Larson

(57) ABSTRACT

The invention is defined as a cargo articulated mechanism complete design, fastened to a personal watercraft rear deck. It functions as a support for lading multiple cargo accessories and incorporates a rotating structure that allows unobstructed access to get on or off the personal watercraft through the rear deck. An incorporated locking mechanism functions as an automatic swing lock that also allows quick release by the user either from the water level or from the rider seat of the personal watercraft.

This invention allows to lade different accessories such as baskets, racks, coolers, supplies, equipment, boxes, and seats.

This invention is designed for all personal watercraft users, including those with mobility restrictions that have restricted access to the personal watercraft when obstructed by a fixed cargo rack fastened on the rear deck.

20 Claims, 15 Drawing Sheets

(56) References Cited

U.S. PATENT DOCUMENTS

| | | | | |
|---|---|---|---|---|
| 11,649,015 | B2 * | 5/2023 | Watkins | B63B 25/18<br>114/55.57 |
| 2022/0266957 | A1 * | 8/2022 | Phillips | B63B 25/28 |

* cited by examiner

PERSONAL WATERCRAFT CARGO ARTICULATED MECHANISM

CROSS-REFERENCE TO RELATED APPLICATIONS

Provisional Application 63/200,240 PERSONAL WATERCRAFT ARTICULATING COOLER RACK, Feb. 24, 2021, Mr. Johnny Robert Phillips This application claims the benefit of U.S. Provisional Application No. 63/200,240, filed Feb. 24, 2021, by the same inventor (Phillips), the entirety of which provisional application is hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB). SEQUENCE LISTING

Not Applicable

STATEMENT REGARDING PRIOR DISCLOSURES BY THE INVENTOR OR A JOINT INVENTOR

Not Applicable

BACKGROUND OF THE INVENTION

(1) Field of the Invention

This invention should be classified as personal watercraft accessory for lading cargo as defined in U.S. patent definitions:

B63B17/00—Vessels parts, details, or accessories, not otherwise provided for

B63B25/00—Load-accommodating arrangements, e.g. stowing, trimming; Vessels characterized thereby

(2) Description of Related Art Including Information Disclosed Under 37 CFR 1.97 and 1.98

The current designs do not provide a solution for the unrestricted user ability to get on from the water surface to the rear deck of personal watercraft. Current designs with fixed cargo structures installed on personal watercraft impede accessibility.

Current designs use diverse types of cargo accessories to be fastened on personal watercraft. These cargo accessories are used for storage and lade of different supplies such as racks, baskets, coolers, or fuel tanks.

Additionally, other structures are used that may secure seats on a personal watercraft.

The following referenced patents describe fixed structures for lade as described above.

Background Art US 2006/0011683 A1 PERSONAL WATERCRAFT CARGO RACK, Jan. 19, 2006, Waine Held Background Art US 2014/8833289 B2 BRACKET FOR A PWC, Sep. 16, 2014, Troy Isaac A broad availability of manufacturers found on the market include different fixed cargo structures to be fastened on personal watercraft, but there is no current design in the market with the same functionalities and solutions for accessibility that are attributes of this invention.

In the background of analyzed designs, it is observed a lack of accessibility due to the equipping of the rear deck that impedes access. These fixed structures designs do not include a feature to allow the freedom of movement through the rear deck of the personal watercraft. Additionally, their fastening features to the personal watercraft is completely different because they lad static loads instead of the fastening features proposed in this invention that proposes a novel swing feature.

This invention enables access to the rear deck using a swing, provided by a rotating frame that frees the space of the rear deck unblocking the movement of the user. The swing feature solves the accessibility without degrading its capacity to lade different supplies. This invention, therefore, provides a lade of supplies capacity whilst allowing access to the rear deck when required by the user.

Additionally, this invention features a tilted axis that allows a balanced swing action.

The rotatable structure swing is performed around a tilted axis to allow a sluggishly swing. This tilt is sufficient to allow the rotatable structure to fully swing without effort but not excessive as to require a large effort to retract the rotatable structure or produce an unsafe swift swing.

A locking mechanism is included in the design to feature a swing lock till the user pushes up a lever for release. Additionally, the locking mechanism features an automatic swing lock when the rotatable structure retracts preventing further swing utilizing a catch.

This innovative invention solves an ergonomic impediment allowing the accessibility to the rear deck utilizing a tilted axis that ensures a balanced swing and utilizing a locking mechanism ensures safe release by the user pushing action and the automatic retention of the swing when retracting the rotatable structure.

BRIEF SUMMARY OF THE INVENTION

This invention consists of an articulated mechanism that is easy to fasten on the rear deck of the personal watercraft. It allows to lade with ease onto cargo accessories such as baskets, coolers, supplies, equipment, and seats and frees up the space of the rear deck for accessibility.

The invention is split into three main assemblies: a fixed structure, a rotatable structure and a locking mechanism that prevents the rotatable structure to swing. The fixed structure fastened to the rear deck of a personal watercraft provides rigidity and stability to the articulated system. The rotatable structure provides a structure that allows the assembly of diverse cargo accessories, and a swing functionality permits the freedom of movement through the rear deck whilst the rotatable structure is fully swung to the port side. The locking mechanism prevents swinging of the rotatable structure till the user releases the swing by raising the locking mechanism.

The fixed structure may be fastened to the rear deck by use of an adjustable clamp, a turnbuckle, and a baseplate resting on the rear deck in a preferred design. An adjustable clamp is secured to a tow point at the rear of the rider seat. A turnbuckle tightly holds the invention to a tow point at the stern. A resting baseplate is placed on the rear deck. These three fasteners allow the full fixation of the fixed structure to the personal watercraft allowing the swing to function without instability.

The rotatable structure swing is performed around a tilted axis to allow a sluggishly swing. This tilt is sufficient to allow the rotatable structure to fully swing without effort but not excessive as to require a large effort to retract the rotatable structure or produce an unsafe swift swing.

Once installed to the personal watercraft, the fastened cargo articulated mechanism consists of metallic parts assembled allowing the swing of the rotatable structure to the port side in this example of preferred design but preventing swing to the starboard side.

The locking mechanism features a slot beneath a lever that allows the insertion of a catch welded to the base panel.

By the user pushing up the lever, the swing is released when the slot is freed from the catch. Once the swing is released the user drops the lever that slides over the catch and eventually hangs from the rotatable structure over-board of the personal watercraft.

When the rotatable structure is retracted by the user, the locking mechanism hangs freely till contacting the catch, then the lever slides over the catch and when the slot meets the catch the lever falls to a locked position that prevents the rotatable structure to swing.

The locking mechanism is designed to allow the user the release of the swing from the water or the rider seat. From the water the user swims and approaches the rear of the personal watercraft and extends his hand to push up the lever that is close to the water level. From the rider seat the lever is released using a lanyard that is pulled up from above by the user.

Except for the spacer pad, to avoid corrosion all metallic parts are made of either aluminum or stainless steel and powder coated. The spacer pad is designed to allow the slide of the swing arm over the rear deck reducing the friction.

All parts of this invention are welded except for swivel joints and bolted on cargo accessories.

This invention allows the assembly of different cargo accessories such as baskets, coolers, supplies, fuel tanks, equipment, and seats and frees the space of the rear deck for accessibility.

BRIEF DESCRIPTION OF THE SEVERAL VIEWS OF THE DRAWING(S)

DETAILED DESCRIPTION OF THE INVENTION

Figure 2:
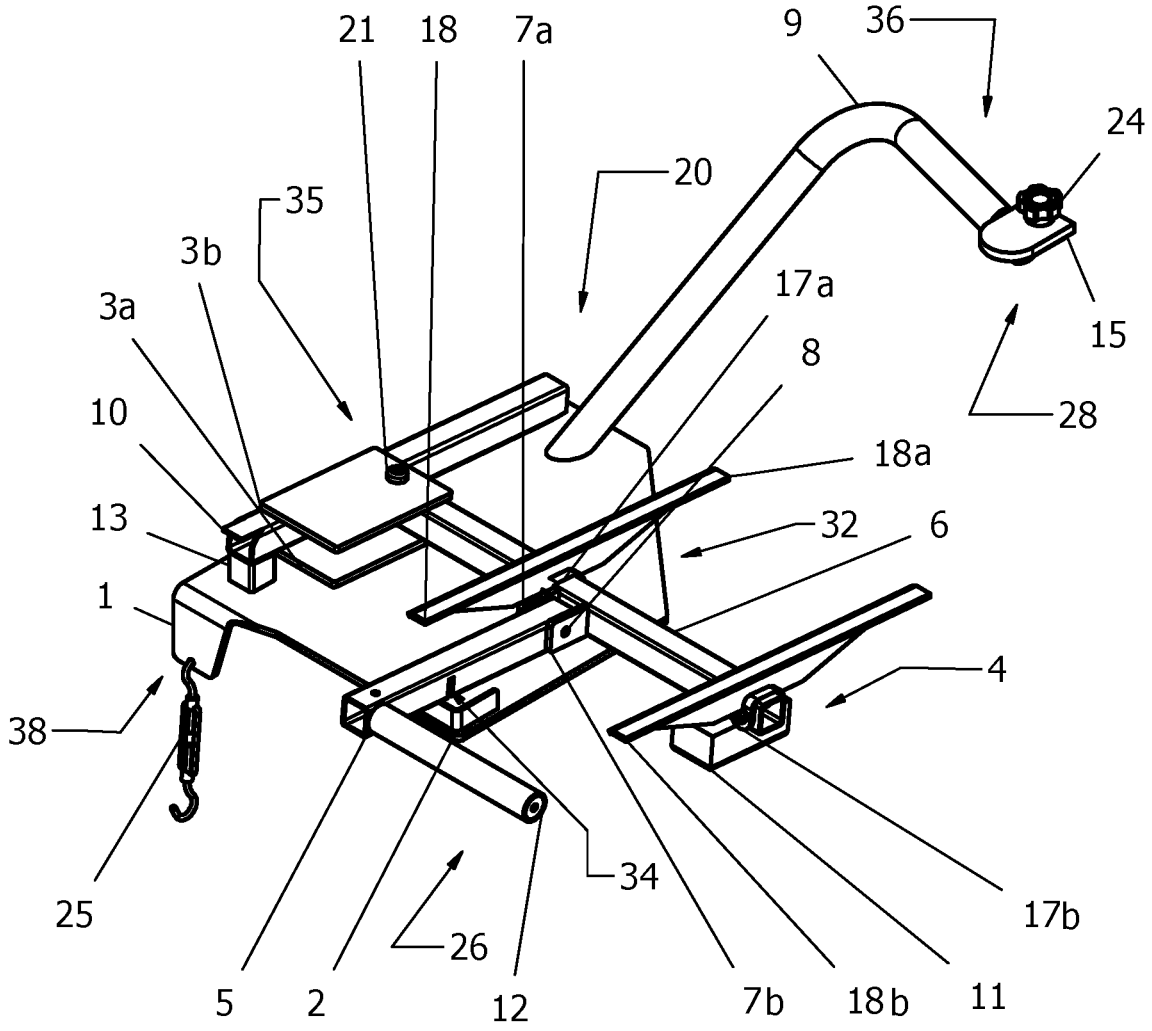
FIG. 2 is a perspective view of a cargo articulated mechanism with a locking mechanism released constructed according to the present invention that shows how the c-shaped brackets and accessories' mount brackets may be assembled to the present invention to allow assembly of cargo accessories.
Figure 14:
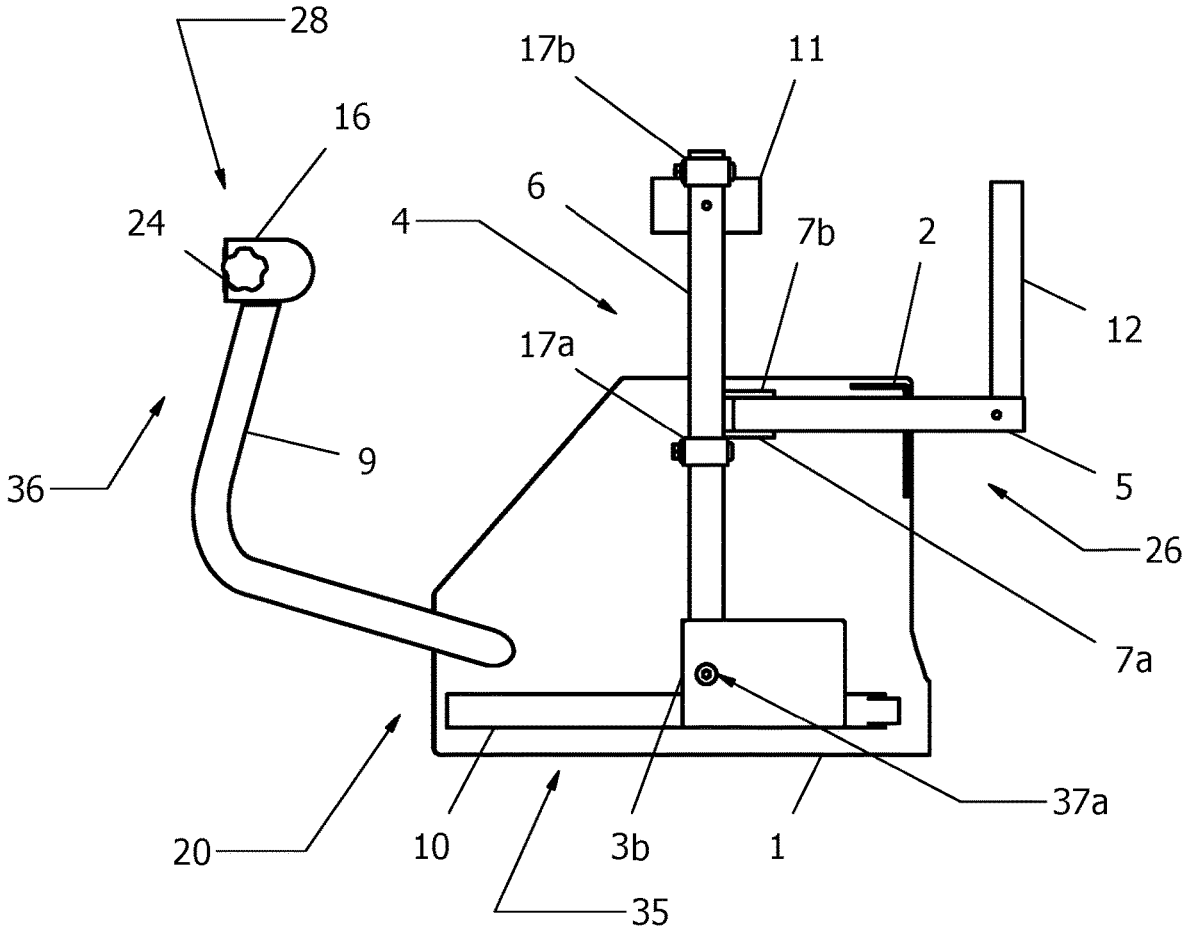
FIG. 14 is a plan view of a cargo articulated mechanism with a locking mechanism caught constructed according to the present invention that shows how the c-shaped brackets may be assembled to the present invention to allow assembly of cargo accessories.

The assembly of the invention accounts for a total of 32 parts, arranged in three assemblies, a fixed structure 20, a rotatable structure 4, and a locking mechanism 26, as shown in FIG. 2 and FIG. 14.

Figure 6:
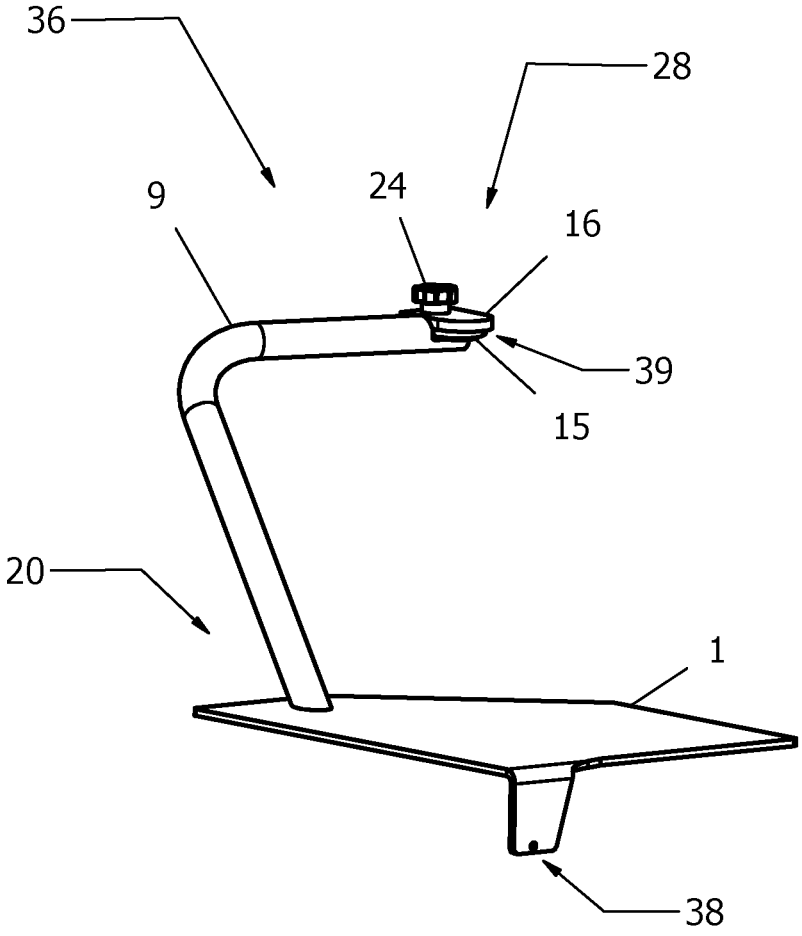
FIG. 6 is a perspective view of a baseplate, and a clamp arm, constructed according to the present invention.
Figure 7:
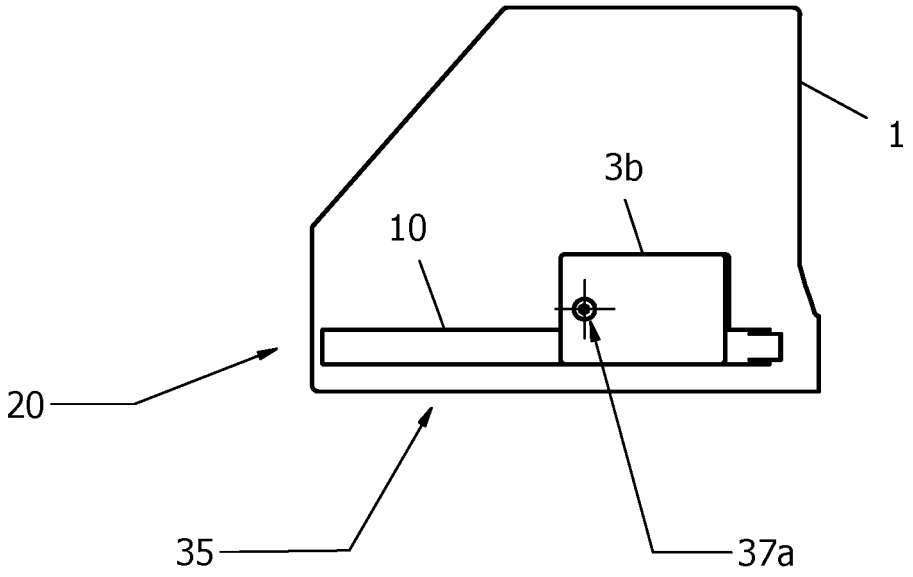
FIG. 7 is a plan view of a baseplate, and a swing support frame, constructed according to the present invention.
Figure 9:
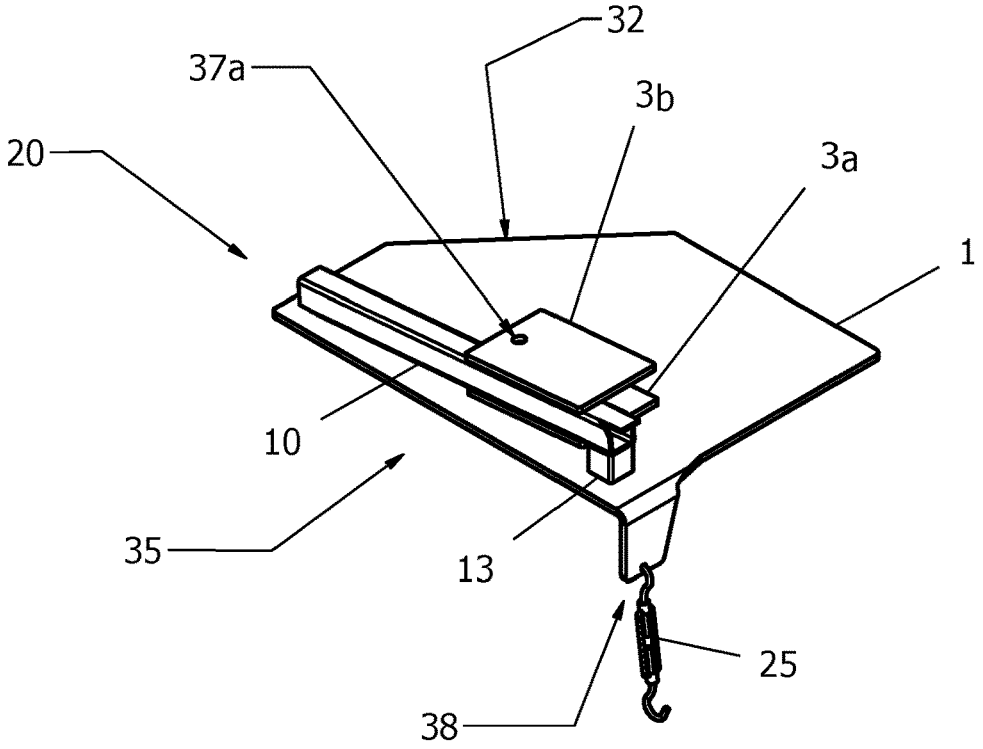
FIG. 9 is a perspective view of a baseplate, a support rail, a post and two guides and a turnbuckle, constructed according to the present invention.

As shown in FIG. 6 and FIG. 9, in a preferred design, the fixed structure 20 may include structures as a clamp arm 36, a baseplate 1, and a swing support frame 35 with the functionality to give support and provide means for installation to the personal watercraft. The fixed structure provides a base, which may be utilizing a baseplate 1, for the invention in contact with the rear deck (not shown). In a preferred design, the baseplate 1 preferred as metallic, shown in FIG. 6, and FIG. 9, is a beveled design.

Figure 1:
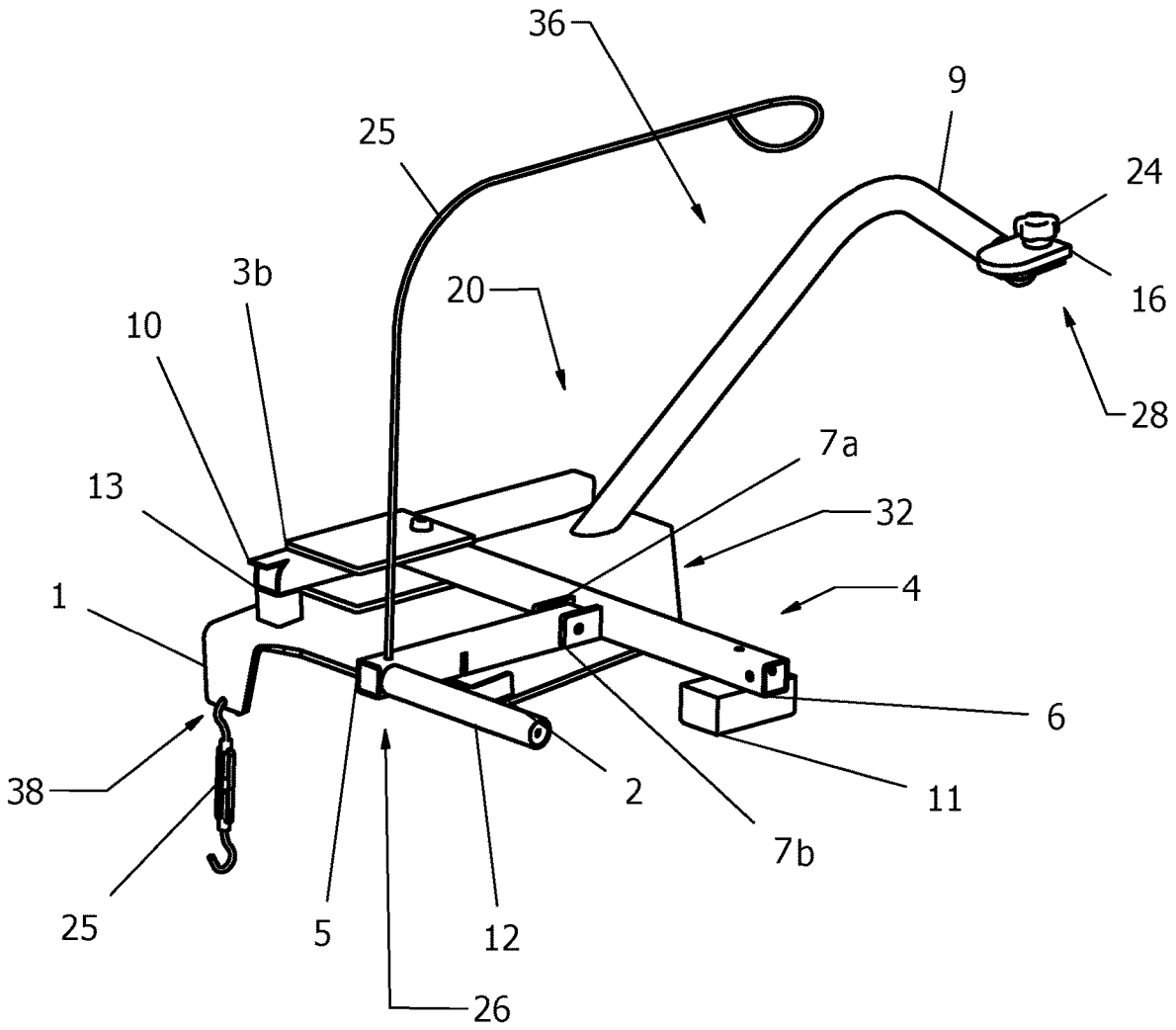
FIG. 1 is a perspective view of a cargo articulated mechanism with a locking mechanism released constructed according to the present invention.
Figure 18:
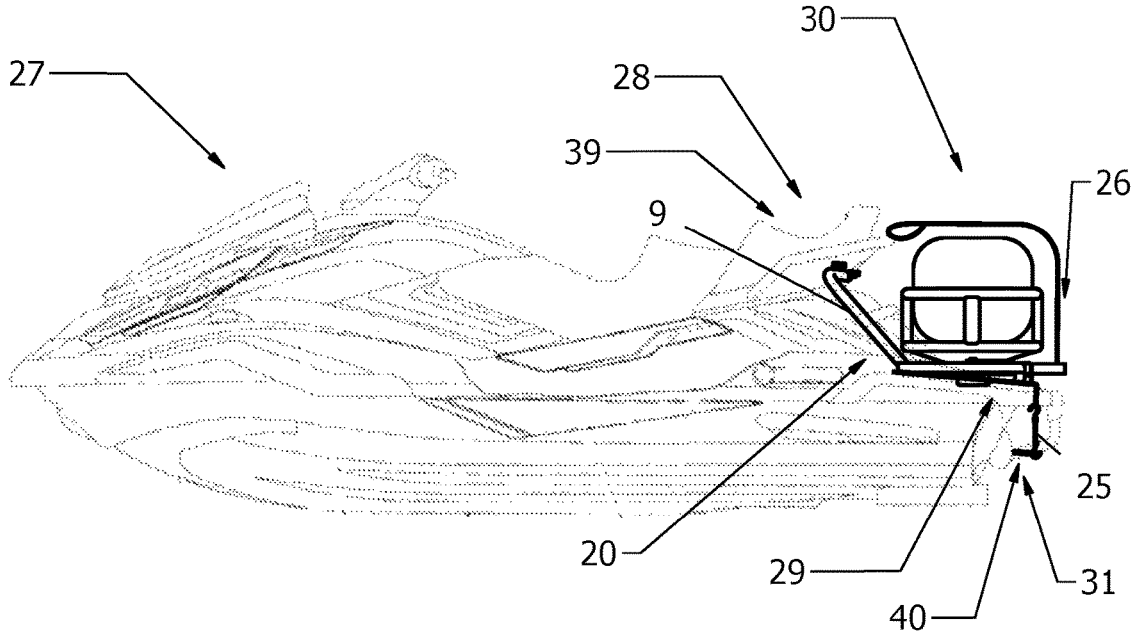
FIG. 18 is a side view of a cargo articulated mechanism constructed according to the present invention, a basket, a dummy supply, and a personal watercraft that shows how the retracted cargo articulated mechanism may be fastened to the personal watercraft.

As shown in FIG. 1 and FIG. 18, the baseplate 1 is shaped with a partial cut 32 and is bent to provide a hole 38 to hook, in a preferred design, a turnbuckle 25 that is hooked on its opposite side to a tow point 40 at the stern 31 of the personal watercraft providing fastening of the invention.

Figure 5:
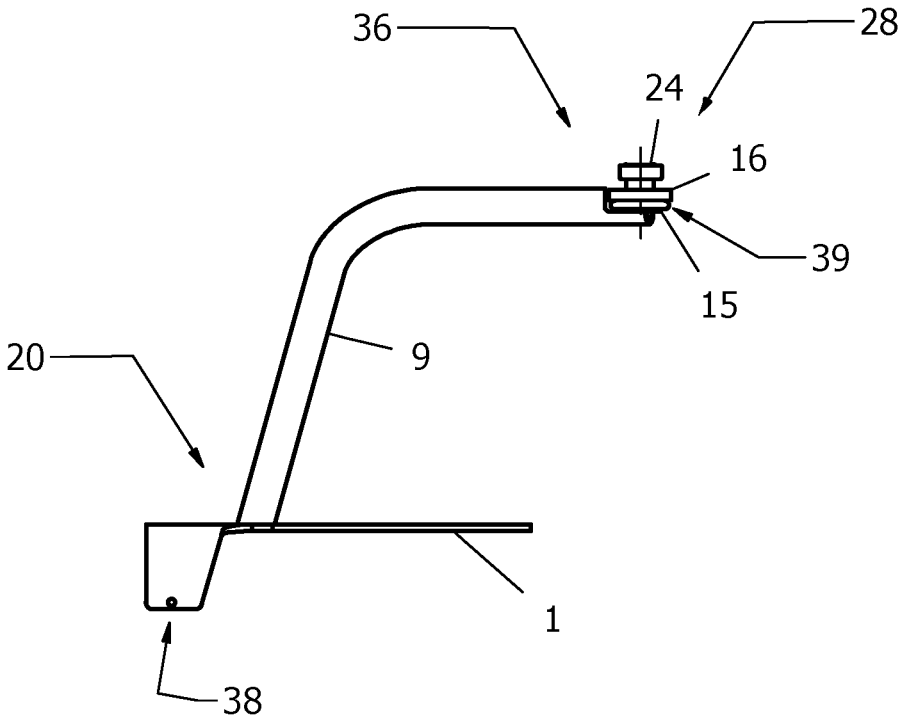
FIG. 5 is a rear elevation view of a baseplate, and a clamp arm constructed according to the present invention.

In FIG. 5, FIG. 14, and FIG. 6 the clamp arm 36 is welded to the fixed structure 20 by the shaped pipe 9 that may be weld to the baseplate 1 in a preferred design.

Figure 19:
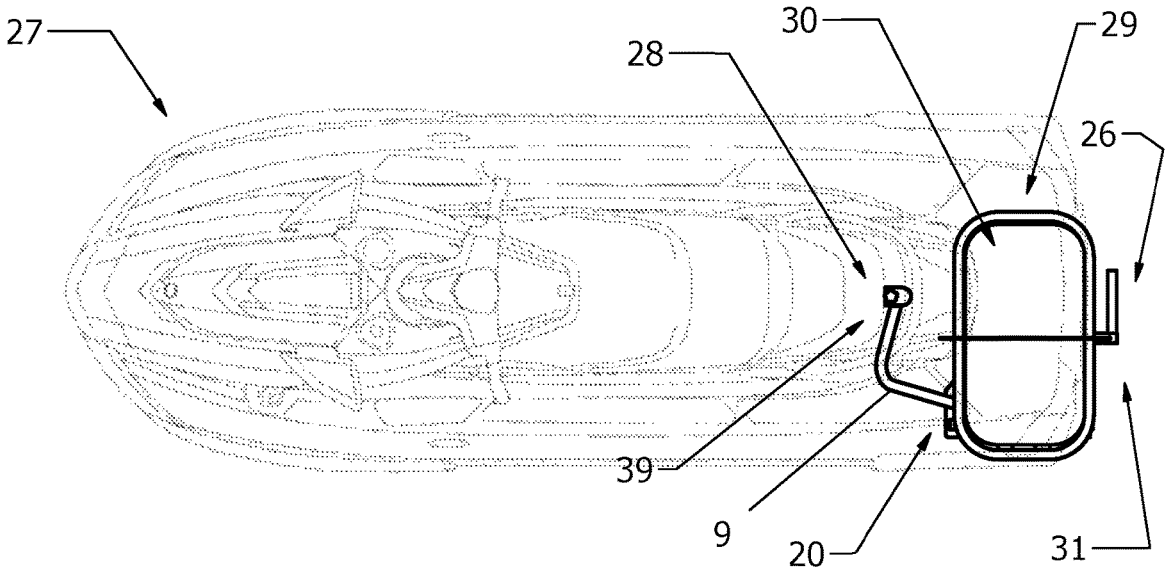
FIG. 19 is a top view of a cargo articulated mechanism constructed according to the present invention, a basket, a dummy supply, and a personal watercraft that shows how the retracted cargo articulated mechanism may be fastened to the personal watercraft.

As shown in FIG. 18, and FIG. 19, in a preferred design, the preferred metallic shaped pipe 9 contours the rear deck 29 and ensures fastening of the invention installation to the personal watercraft utilizing an adjustable clamp 28 locked onto a tow point 39 behind the rider seat.

Figure 4:
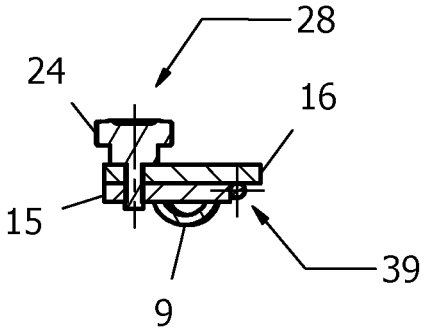
FIG. 4 is a side cross-sectional view of an adjustable clamp with a knob locked at a tow point, constructed according to the present invention.

As shown in FIG. 4, FIG. 5, and FIG. 6, in a preferred design, the clamp arm 36 is locked to the tow point 39 behind the rider seat rear by an adjustable clamp 28 consisting of a lock plate 16, and a lock shoe 15 both preferred metallic.

As shown in FIG. 4, FIG. 5, and FIG. 6, in a preferred design, welded to shaped pipe 9, the lock shoe 15 of rectangular section and a rounded end allocates a threaded bushing. The rounded end is designed to fit into the buckle of the seat tow point 39 and the threaded bushing is designed to hold a knob 24 that through a bushing in the lock plate 16 holds tight the adjustable clamp 28 feature of the clamp arm 36. The plastic head knob 24 is featured to ease the fastening of this invention in a preferred design. The lock plate 16 with a larger dimension than the lock shoe 15 secures to the seat tow point 39 ensuring an adjustable clamping of this invention to the personal watercraft.

Figure 10:
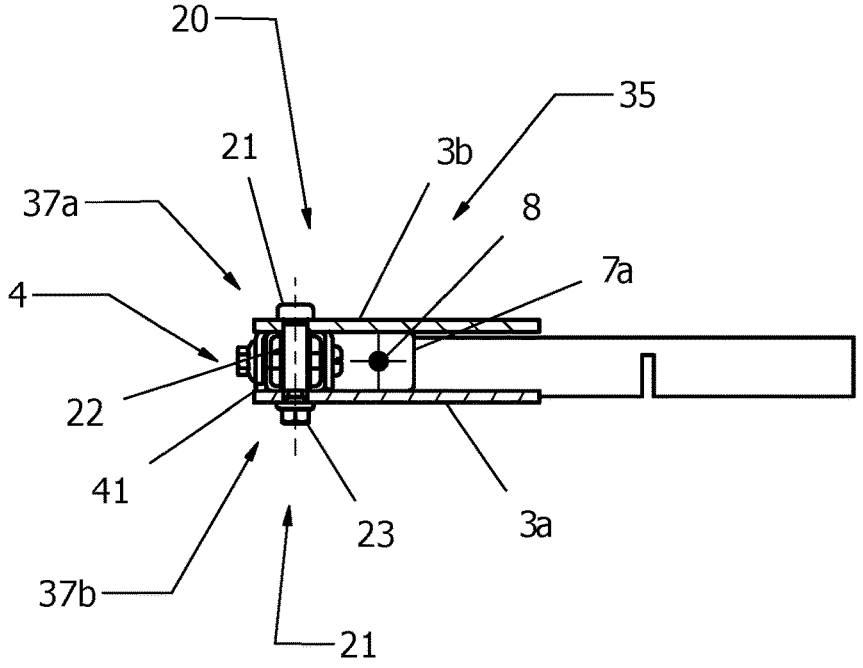
FIG. 10 is a partial cross-sectional view of two guides, an axle bolt and a swing arm constructed according to the present invention that shows how the rotatable structure is assembled to the fixed structure's guides in the present invention and how the c-shaped bracket may be assembled to the present invention to allow assembly of cargo accessories.

As shown in FIG. 2, FIG. 7, FIG. 10, and FIG. 14, the fixed structure 20 includes a swing support frame 35 that has two main functionalities, give fixed support of a swivel joint that allows the swing of the rotatable structure 4, and provide a tilt to the swing to allow a balanced swing utilizing aligned holes 37*a* and 37*b* in guides 3*a* and 3*b* that may be pinned by axle bolt 21 in a preferred design as shown in FIG. 2, and FIG. 10.

As shown in FIG. 9, in a preferred design, the swing support frame 35 with preferred metallic parts is welded to the fixed structure 20 by a support rail 10 and a post 13 that may be welded to the baseplate 1 in a preferred design.

Figure 8:
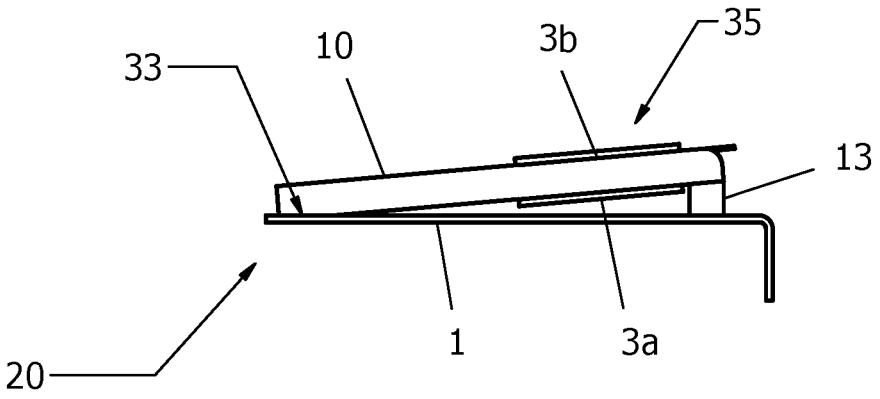
FIG. 8 is a side view of a baseplate and a swing support frame, constructed according to the present invention.

In FIG. 8 the support rail 10 with squared section, preferred metallic, beveled, incorporates a partial oblique cut 33 on one end provides the angle that requires the tilt for a balanced swing. As shown in FIG. 2, FIG. 8, and FIG. 9, the partial oblique cut 32 of the support rail 10 is welded to the fixed structure 20 that may be weld to the baseplate 1 in a preferred design. At the opposite side, the support rail 10 is supported by a weld to post 13 which is welded also to the fixed structure 20 that may be weld to the baseplate 1 in a preferred design. The post 13 with squared section provides the sufficient distance to allow the swing without producing mechanical interferences whilst contributing to defining the balanced tilt of the rotatable structure 4.

As shown on FIG. 2, FIG. 8, FIG. 9, and FIG. 10, the swing support frame 35 includes guides 3*a* and 3*b* welded to the support rail 10 between the partial oblique cut 32 and post 13, both guides 3*a* and 3*b* have holes 37*a* and 37*b* that are aligned to provide a tilted axis to allow a balanced swing. The swing support frame 35 is used to assemble the swing arm 6 as a swivel joint that may be utilizing an axle bolt 21, a bushing 22, and a nut 23 in a preferred design. The swing arm 6 overhangs and turns around the aligned holes 37*a* and 37*b*, that may be pinned by axle bolt 21 in a preferred design allowing the rotatable structure 4 to be rotatively linked to the fixed structure 20. The swing arm 6 is a beam, preferred metallic, with a beveled square section.

Additionally, as shown on FIG. 10, the fixed structure 20 includes a stop 41 that may be welded to the guide 3*a* in a preferred design. The stop 41 allows the rotatable structure 4 to swing towards the rear of the personal watercraft but blocks the rotatable structure 4, that may be blocking the swing arm 6 in a preferred design, to swing to the front avoiding it to contact the rear of the rider seat.

Figure 11:
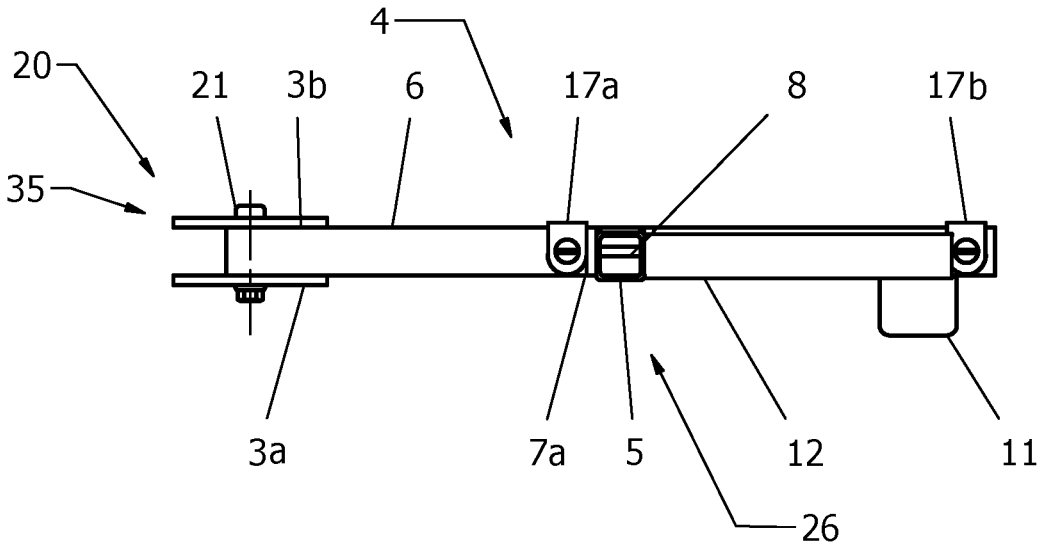
FIG. 11 is a rear elevation view of a rotatable structure, two guides, and an axle bolt constructed according to present invention that shows how the rotatable structure is assembled by an axle bolt to the fixed structure's guides in the present invention and how the c-shaped bracket may be assembled to the present invention to allow assembly of cargo accessories.

At FIG. 2 the locking mechanism 26 is rotatively linked to the rotatable structure 4 as a swivel joint by pin 8 welded to tabs 7*a* and 7*b* that are welded to the swing arm 6. In FIG. 2, and FIG. 11, the locking mechanism is a lever 5 with a hole (not shown) of beveled square section that rotates around pin 8. In FIG. 1, the lanyard 25 is attached to a hole on lever 5 allowing to pull up the locking mechanism 26 from above by the user at the rider seat.

Figure 12:
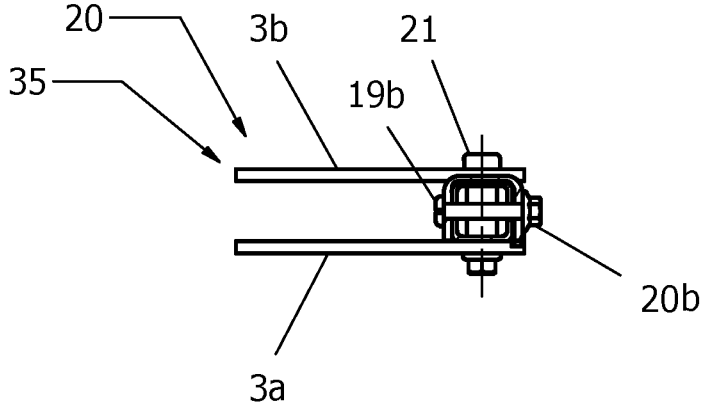
FIG. 12 is a partial cross-sectional view of two guides, an axle bolt and a swing arm constructed according to the present invention that shows how the rotatable structure is assembled to the fixed structure's guides in the present invention and how the c-shaped bracket may be assembled to the present invention to allow assembly of cargo accessories.
Figure 13:
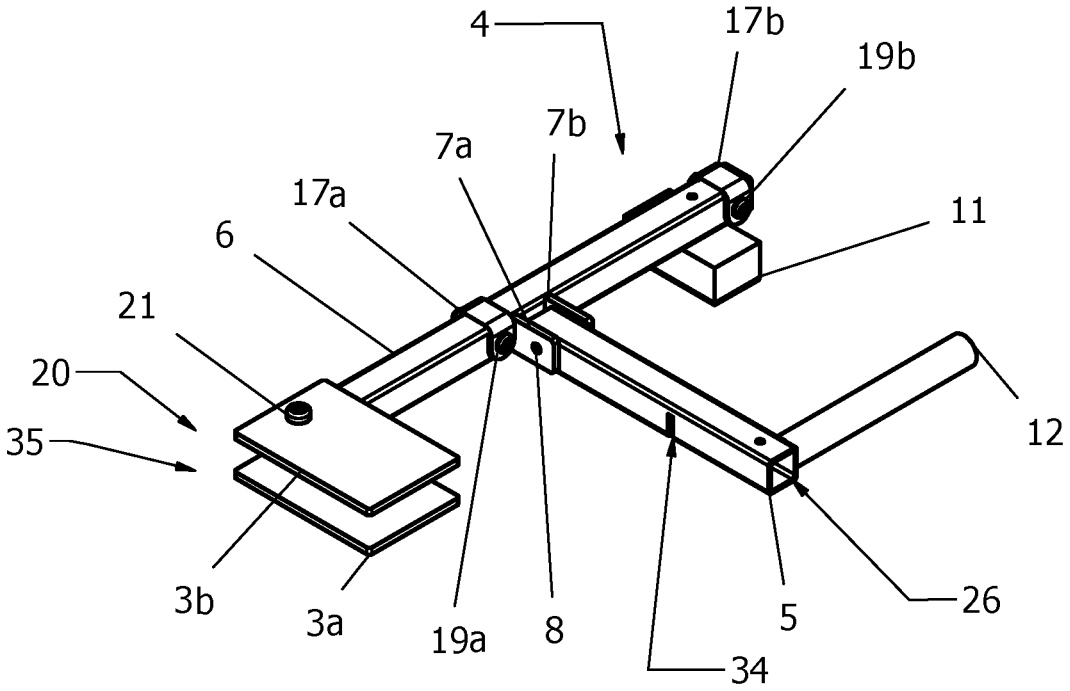
FIG. 13 is a perspective view of a rotatable structure, two guides, an axle bolt and a locking mechanism constructed according to the present invention that shows how the rotatable structure is assembled to the fixed structure's guides in the present invention and the c-shaped brackets may be assembled to the present invention to allow assembly of cargo accessories.

As shown in FIG. 2 in the opposite side to the axle bolt 21 the swing arm 6 screws a spacer pad 11 preferably made of plastic, that functions as a support when the rotatable structure 4 rests on the rear deck (not shown). Diverse cargo accessories (not shown) may be welded to c-shaped brackets 17*a* and 17*b*, as shown in FIG. 12 and FIG. 13 that are bolted to the swing arm 6 by bolts 20*b* (and another not shown), and nuts 19*a* and 19*b*.

Figure 3:
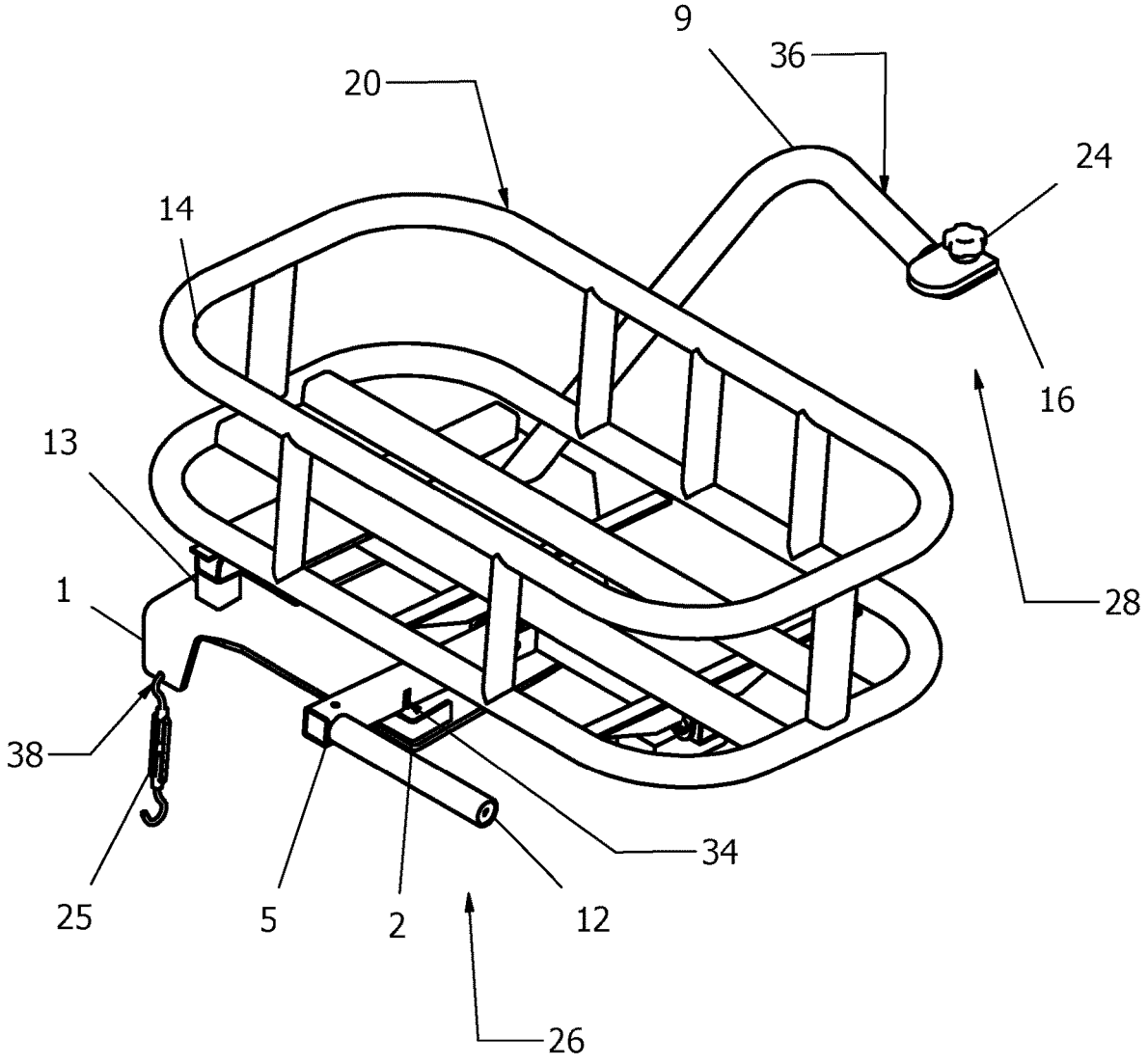
FIG. 3 is a perspective view of a cargo articulated mechanism with a locking mechanism released constructed according to the present invention that shows how a cargo accessory such as a basket may be assembled to the present invention to allow lading of supplies.

FIG. 2 includes accessories' mount brackets 18*a* and 18*b* preferred metallic with powder coating of L-shaped bent section and that are welded respectively to c-shaped brackets 17*a* and 17*b*. C-shaped brackets 17*a* and 17*b*, and accessories' mount brackets 18*a* and 18*b*, are featured to assemble different cargo accessories to swing arm 6, in example a basket 14 as represented in FIG. 3. In FIG. 2, the basket (not shown) is a common cargo accessory, preferred metallic and powder coated, and preferably is weld to accessories' mount brackets 18*a* and 18*b*.

In FIG. 2, at the swing arm 6 middle section the locking mechanism 26 is assembled utilizing tabs 7*a* and 7*b* and pin 8 that are preferred metallic, and powder coated parts. Tabs 7*a* and 7*b* are welded to swing arm 6 and pin 8 is welded to the tabs allowing the free rotation of the locking mechanism 26. The locking mechanism 26 consists of a lever 5, preferred metallic of square beveled section includes a hole to allow rotation around pin 8. The lever 5 also includes below a slot 34 as shown in FIG. 2. The lever 5 is caught utilizing its slot 34 and catch 2. The catch 2 is a preferred metallic bent plate welded to the fixed structure 20 that may be welded to the baseplate 1 in a preferred design.

FIG. 2 shows a handle 12 welded at the end of lever 5 allowing an ergonomic ease of handling when the user requires to release the locking mechanism 26 by a push up action from sea-level. The handle 12 is of circular section and preferred metallic with powder coating. The locking mechanism 26 is shown caught in FIG. 16 and released in FIG. 2.

Figure 15:
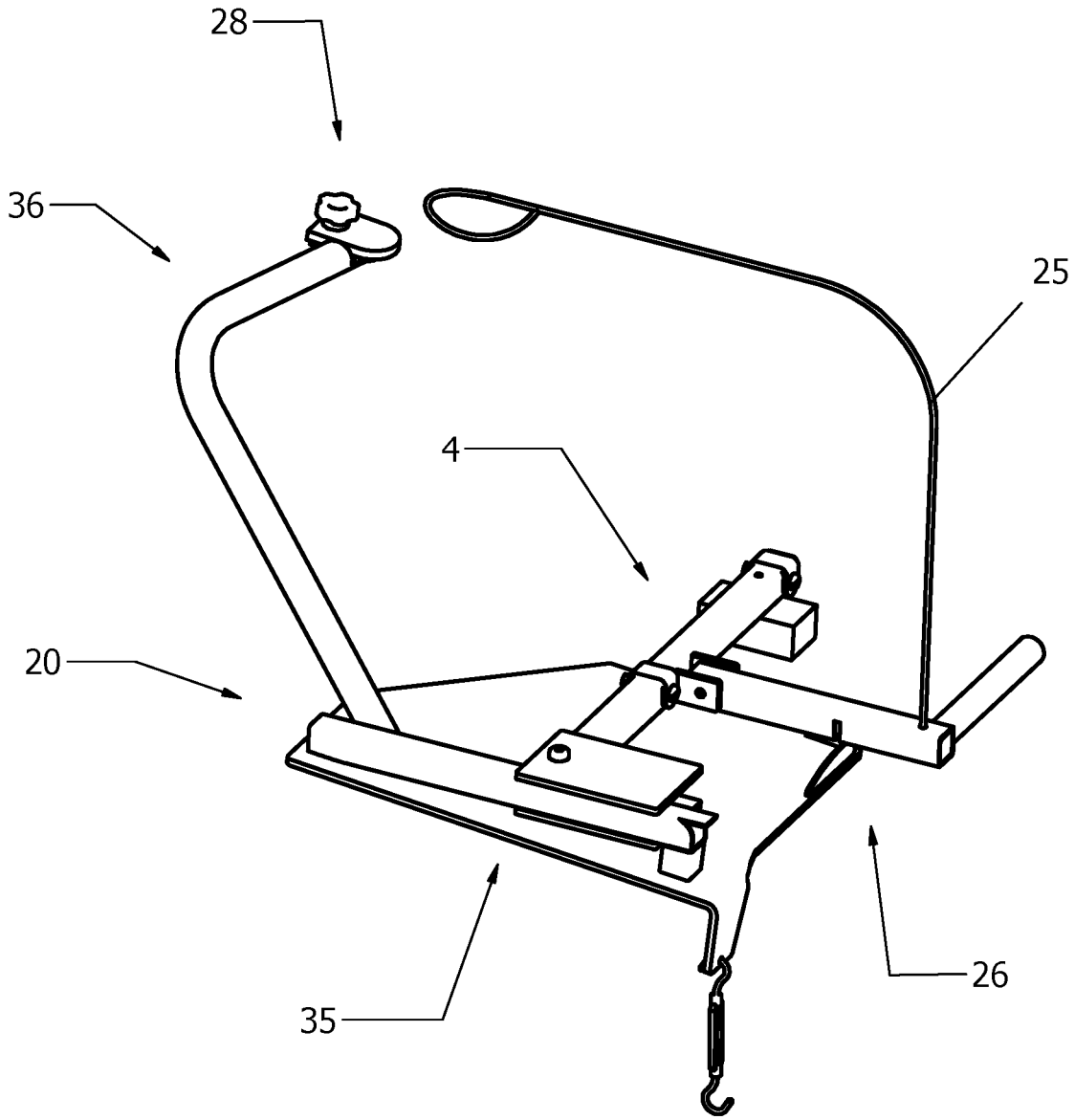
FIG. 15 is a perspective of a cargo articulated mechanism with a locking mechanism released constructed according to the present invention that shows how the c-shaped brackets may be assembled to the present invention to allow assembly of cargo accessories.
Figure 16:
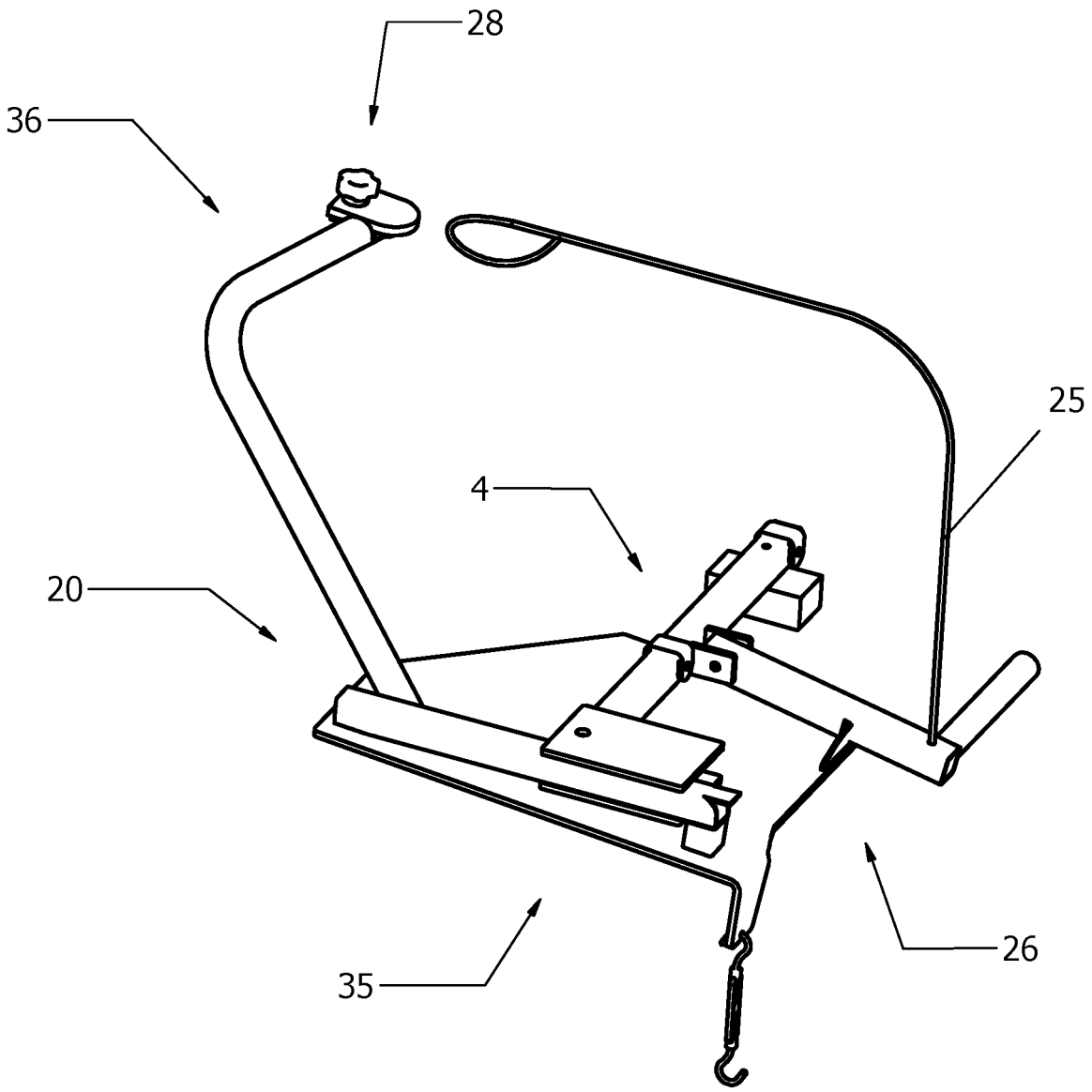
FIG. 16 is a perspective of a cargo articulated mechanism with a locking mechanism caught constructed according to the present invention that shows how the c-shaped brackets may be assembled to the present invention to allow assembly of cargo accessories.
Figure 17:
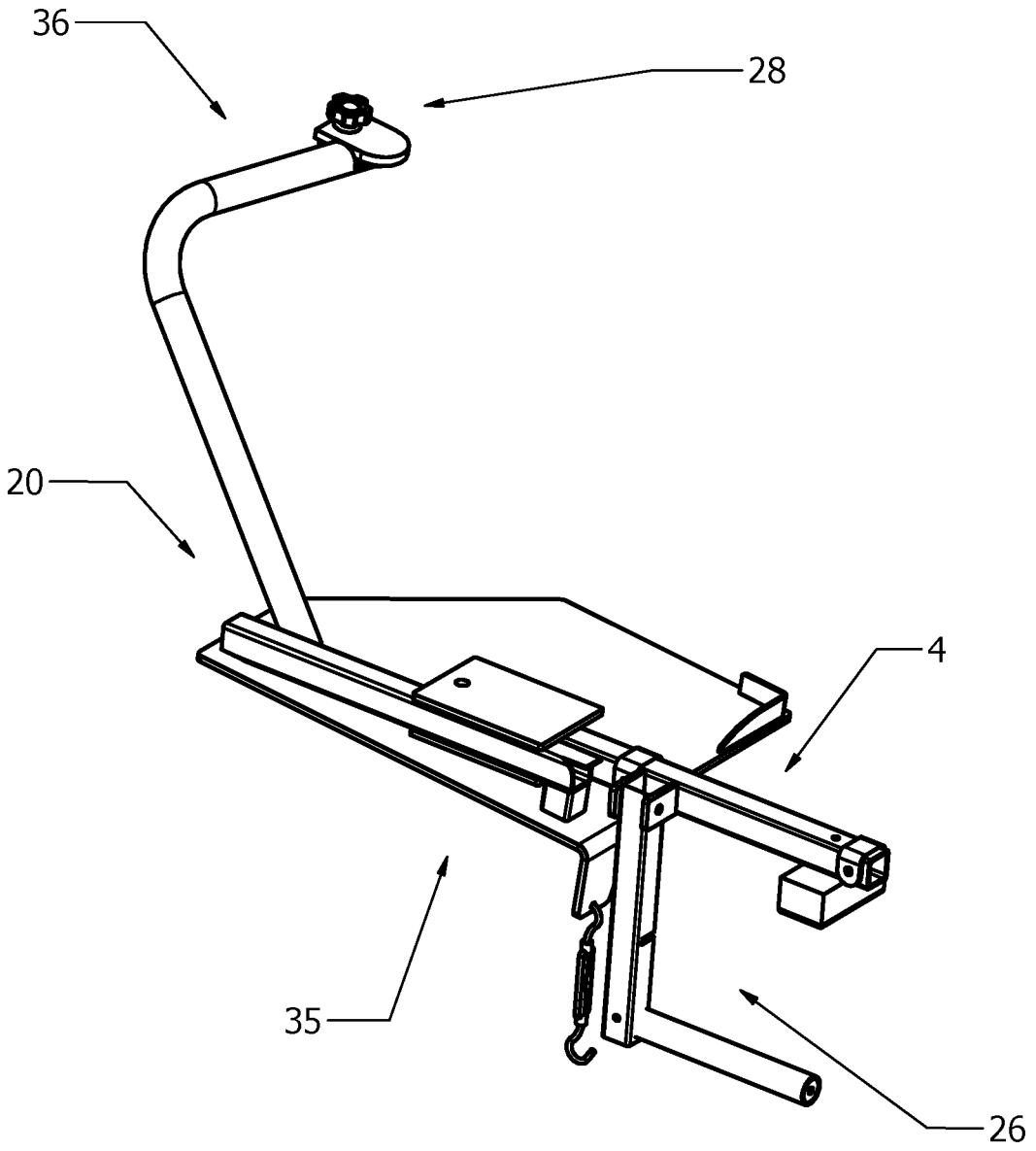
FIG. 17 is a perspective of a cargo articulated mechanism fully swung to the port side constructed according to the present invention that shows how the c-shaped brackets may be assembled to the present invention to allow assembly of cargo accessories.

The FIG. 15, FIG. 16, and FIG. 17 represent schema of the swing and locking mechanism 26 action on a perspective view.

The FIG. 15 shows the rotatable structure 4 retracted and the locking mechanism 26 released.

The FIG. 16 shows the rotatable structure 4 retracted and the locking mechanism 26 caught.

The FIG. 17 shows the rotatable structure 4 fully swung to the port side.

The FIG. 18, and FIG. 19, show this invention, with its rotatable structure (not shown) retracted installed onto a personal watercraft 27, as a preferred design, that lads a dummy supply 30. The invention may be fastened to the personal watercraft rear deck utilizing an adjustable clamp 28 at the top assembled onto a personal watercraft's tow point 39 behind the rider seat, and a turnbuckle 25 at the bottom assembled onto a personal watercraft's tow point 40 at the stern 31, and the fixed structure 20 resting on the personal watercraft's rear deck 29.

Figure 20:
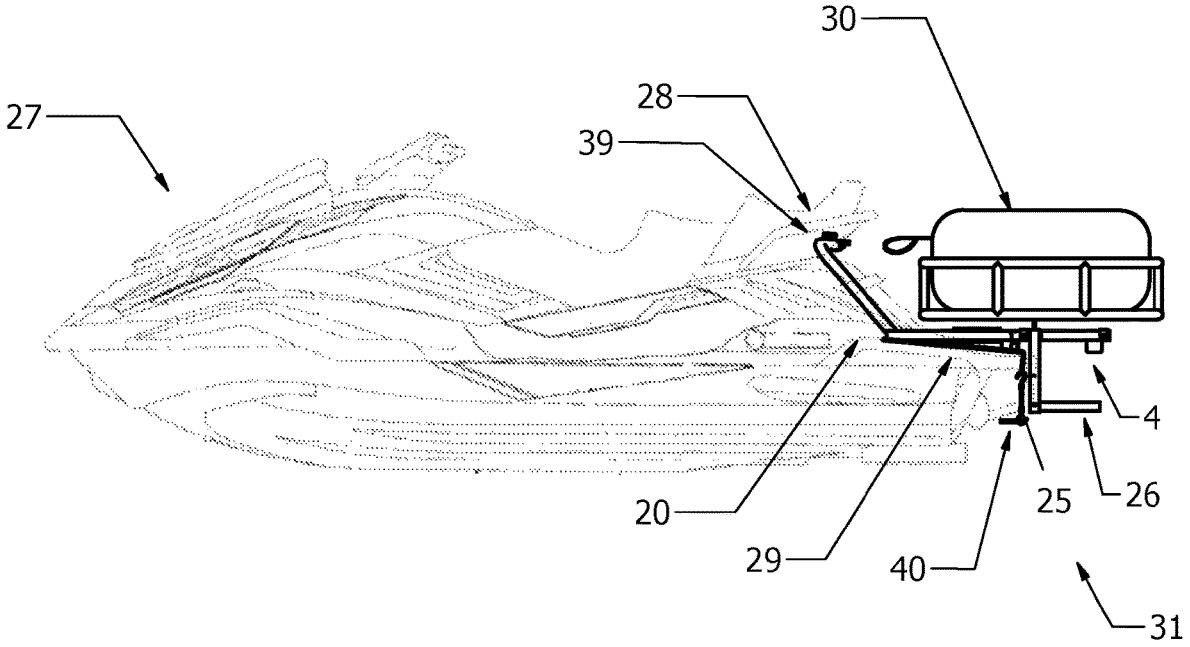
FIG. 20 is a side view of a cargo articulated mechanism constructed according to the present invention, a basket, a dummy supply, and a personal watercraft that shows how the fully swung to the port side cargo articulated mechanism may be fastened to the personal watercraft.
Figure 21:
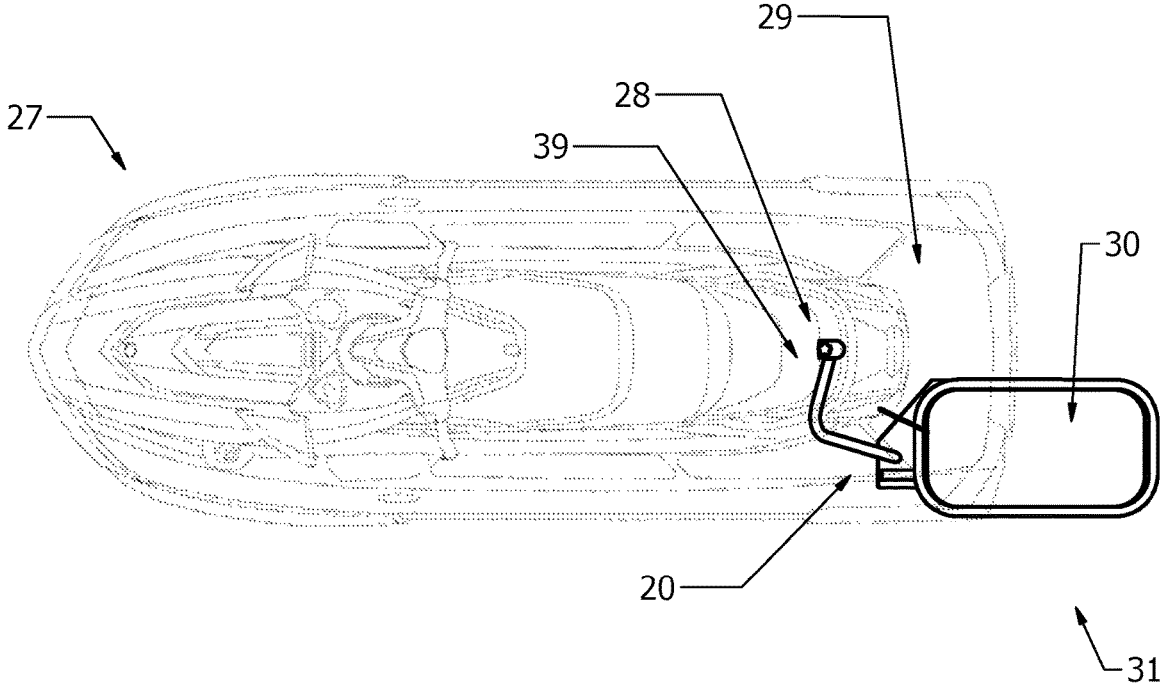
FIG. 21 is a top view of a cargo articulated mechanism constructed according to the present invention, a basket, a dummy supply, and a personal watercraft that shows how the fully swung to the port side cargo articulated mechanism may be fastened to the personal watercraft.

The FIG. 20, and FIG. 21, show this invention, with its rotatable structure (not shown) fully swung to the port side installed onto a personal watercraft 27, as a preferred design, with a basket 14 that lads a dummy supply 30. The invention may be fastened to the personal watercraft rear deck utilizing an adjustable clamp 28 at the top assembled onto a personal watercraft's tow point 39 behind the rider seat, and a turnbuckle 25 at the bottom assembled onto a personal watercraft's tow point 40 at the stern 31, and the fixed structure 20 resting on the personal watercraft's rear deck 29. The FIG. 21 shows freedom of movement along the rear deck 29 allowing easy access of a swimming user near the stern 31 to board the personal watercraft from the water surface.

The structures and methods disclosed herein illustrate the principles of the present invention. The invention may be embodied in other specific forms without departing from its Spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the Scope of the invention.

The invention claimed is:

1. A cargo articulated mechanism comprising:

a fixed structure fastened to a personal watercraft's rear deck;

a rotatable structure rotatably connected to said fixed structure such that said rotatable structure swings about a balanced tilt axis through the rear deck of the personal watercraft;

a cargo accessory to carry supplies that assembles to said rotatable structure;

a locking mechanism that retains retracted said rotatable structure, until released allowing said rotatable structure capacity to swing.

2. A cargo articulated mechanism as in claim 1, further comprising a clamp arm, wherein said claim arm further comprises: a shaped pipe which contours the personal watercraft rear deck towards the rear of the rider seat;

an adjustable clamp welded to said shaped pipe, which secures onto a tow point at the rear of the personal watercraft rider seat;

a knob assembled to said adjustable clamp, to allow quick adjustment of said adjustable clamp.

3. A cargo articulated mechanism as in claim 1, wherein said fixed structure further comprises a baseplate that rests onto the personal watercraft rear deck.

4. A cargo articulated mechanism as in claim 2, wherein said clamp arm is welded to said fixed structure.

5. A cargo articulated mechanism as in claim 1, wherein said fixed structure further comprises a turnbuckle hooked to said fixed structure, that also is hooked to a tow point at the stern of the personal watercraft.

6. A cargo articulated mechanism as in claim 1, further comprising a swing support frame, wherein said swing support frame further comprises:

a support rail;

a post welded to said support rail;

a set of guides welded to said support rail;

a set of holes in said guides aligned to provide said balanced tilt axis.

7. A cargo articulated mechanism as in claim 6, wherein said support rail and said post are welded to said fixed structure.

8. A cargo articulated mechanism as in claim 7, wherein said fixed structure further comprises an axle bolt introduced though said holes, which acts as a pin and allows a swing at a tilted axis of said rotatable structure.

9. A cargo articulated mechanism as in claim 7, wherein said fixed structure further comprises a bushing introduced though said holes, which acts as a plain bearing of said rotatable structure.

10. A cargo articulated mechanism as in claim 1, wherein said rotatable structure further comprises a spacer pad that provides support to said rotatable structure when retracted.

11. A cargo articulated mechanism as in claim 1, wherein said cargo accessory is a basket.

12. A cargo articulated mechanism as in claim 1, wherein said cargo accessory is a cooler.

13. A cargo articulated mechanism as in claim 1, wherein said cargo accessory is a fuel tank.

14. A cargo articulated mechanism as in claim 1, wherein said cargo accessory is a seat.

15. A cargo articulated mechanism as in claim 1, wherein said locking mechanism further comprises a slot.

16. A cargo articulated mechanism as in claim 15, wherein welded to said fixed structure further comprises a catch that enables when inserted in said slot to lock retracted said rotatable structure, and catches sliding said locking mechanism by inserting in said slot when said rotatable structure is retracting.

17. A cargo articulated mechanism as in claim 1, wherein said locking mechanism further comprises a lanyard that allows to release said rotatable structure by the user riding the personal watercraft.

18. A cargo articulated mechanism as in claim 1, wherein said fixed structure further comprises a stop that blocks the said rotatable structure to swing to the front avoiding it to contact the rear of the rider seat.

19. A cargo articulated mechanism as in claim 1, wherein said fixed structure, said rotatable structure, and said locking mechanism, are made of metal.

20. A cargo articulated mechanism as in claim 19, wherein said fixed structure, said rotatable structure, and said locking mechanism, are powder coated to strengthen the parts and to avoid corrosion.

* * * * *